US006227255B1

(12) United States Patent
Osterberg et al.

(10) Patent No.: US 6,227,255 B1
(45) Date of Patent: May 8, 2001

(54) WARPED-REINFORCED WOVEN FABRIC

(75) Inventors: Lars Osterberg, Halmstad; Goran Nilsson, Oskarstrom, both of (SE)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 09/211,421

(22) Filed: Dec. 15, 1998

(30) Foreign Application Priority Data

Dec. 15, 1997 (SE) ..... 9704694

(51) Int. Cl.[7] ..... D21F 1/10
(52) U.S. Cl. ..... 139/383 A; 139/206
(58) Field of Search ..... 139/383 A, 206

(56) References Cited

U.S. PATENT DOCUMENTS 4,501,303 * 2/1985 Osterberg ..... 139/383 A
5,632,310 * 5/1997 Yasuouka ..... 139/383 A
5,799,707 * 9/1998 Barrett et al. ..... 139/383 A
5,806,569 * 9/1998 Gulya et al. ..... 139/383 A
5,839,479 * 11/1998 Gulya et al. ..... 139/383 A
5,988,229 * 11/1999 Quigley ..... 139/383 A

* cited by examiner

*Primary Examiner*—Andy Falik
(74) *Attorney, Agent, or Firm*—Pitney, Hardin, Kipp & Szuch LLP

(57) ABSTRACT

A woven fabric for a paper machine, board machine or the like has a single-layered structure formed of machine-direction (MD) threads which bind with cross-direction (CD) threads in a 2-shed repeated pattern to provide the fabric with a 2-shed top surface for carrying a web of material. The fabric also has reinforcing threads, which are in the machine direction and which bind with the CD threads in an n-shed repeated pattern, where n is equal to or greater than 5, providing the fabric with reinforcing flotations in the machine direction on the bottom surface of the fabric. The reinforcing threads bind with only one CD thread per repeat and are as fine as or finer than the MD threads. The MD threads, the CD threads and the reinforcing threads are all made of polymeric material.

16 Claims, 3 Drawing Sheets

WARPED-REINFORCED WOVEN FABRIC

FIELD OF THE INVENTION

This invention concerns a woven fabric for use in a paper machine, board machine or the like. The invention is especially developed for the forming section, but can also be used in other positions.

BACKGROUND ART

Dewatering in a paper machine is normally made in three different steps, and the earlier in the machine the dewatering is made, the more cost-effective it is:

1. The forming section removes water by drainage from a web by means of suction boxes, by vacuum, table rolls, foils, etc. In older machines of the Fourdrinier type, such dewatering takes place on one side through the so-called extended wire. In modern wire sections, it has been possible to increase the dewatering by injecting the stock between a pair of wires, which permits the water to be drained from both the upper and the lower side. This entails that the wire section can generally be made shorter and more compact. The web is here still weak and is normally passed to the press via a pick-up felt. The purpose of the latter development was to improve the paper characteristics, inter alia, by making it possible to reduce the twosidedness of the web. This is also a condition for running in a stable way at high speeds.
2. In the press section, the web is drained by being subjected to pressure in press nips between one or, alternatively, two felts. The felt covering removes the water and is reconditioned. To make it possible to increase the efficiency in this section, the number of press nips have in many cases been increased to four. Another solution for increasing the capacity has been to replace traditional press nips with so-called extended nips, where the pressing takes place with a shoe as support. In this type of presses, use is made of flexible belts which constitute the roll coating around the shoe. The demands placed on this type of polymer-coated process belts are that they should have a smooth surface and yield a uniform distribution of pressure when passing over the shoe. After the press section, the paper web has such a strength and dry solids content that it may be exposed to a certain amount of tension in the next transfer to the dryer section. In the future, machine concepts will be available, where the web is supported via various belts, etc., through the entire machine.
3. The dryer section dewaters by the web being pressed against steam-heated drying cylinders. There are a number of different solutions to the arrangement of these cylinders and the orientation thereof in order to increase the efficiency in the dryer section.

In wire sections of the twin-wire type, as stated under 1 above, it is possible to have new options regarding the design of suitable fabrics. This depends on the facts that both fabrics work supported by different machine elements in the wire loop, and that these are placed close to each other. The fabric is subjected to a more constant load around the wire loop than in the older wire sections of the Fourdrinier type. In these, a very high stability was required in, e.g., the machine direction for the fabric to resist the pulsating strains that may occur around the revolution.

Known fabrics exist in both single-layered and multilayered design. These include one or more thread systems in the machine direction (MD) and the cross direction (CD), respectively. In order to achieve wear resistance, it is common to choose coarse threads in the CD in the fabric bottom, which is turned to the supporting parts of the machine. Regarding these reinforcements in known fabrics, the reinforcing threads are generally coarse and have higher wear resistance than other threads. It is common to use PA in the bottom. This material does not have higher modulus than PET.

Older single-layered fabrics of metal (bronze alloys) had the disadvantage that their running time was too short. In the 1970's, fabrics made of polymeric material made a breakthrough. Single-layered fabrics with 2-shed surface were, however, not stable enough, so multi-shed patterns (5-shed and above) were run with some success. These single-layered fabrics had too low a stability and too short a running time. To a large extent, they were replaced by multilayered designs of the type double-layered and triple-layered fabrics. Single-layered fabrics have almost completely disappeared from the market.

The drawbacks of today's multilayered fabrics are, among other things, that they do not cope with the high machine speeds that are desired and that they drag too much water. Water currents and pulsations may occur in the fabric. Prior-art single-layered fabrics with a 2-shed pattern especially suffer from the drawback that they are unstable due to a high degree of waviness (crimp) in the individual threads.

The object of the present invention is to provide a thin and stable fabric that especially functions in a twin-wire section and that produces good dewatering also at high machine speeds, above 2000 m/min. The fabric should be easy to keep clean and should drag a minimum amount of water. This results in a better production economy while retaining the paper quality. If the fabric is to be used in the dryer section, a minimum of air friction and thin boundary layers around the fabric are desirable.

SUMMARY OF THE INVENTION

In the light of that stated above, a woven fabric for a paper machine, board machine or the like is provided according to the invention, said fabric, in operation, having a defined machine direction (MD) and a defined cross direction (CD) and said fabric comprising a single-layered structure composed of threads in the machine direction (MD threads) interwoven with threads in the cross direction (CD threads) in a 2-shed repeated pattern in order to form a 2-shed top surface for carrying a web of material, and one reinforcement arranged on the opposite surface (bottom surface) of the single-layered structure and being in the form of reinforcing threads in the machine direction (MDF threads), which bind only with the CD threads in an n-shed repeated pattern, where $n \geqq 5$, and thus create reinforcing flotations in the machine direction on the bottom surface of the single-layered structure, said MDF threads binding only with one CD thread per repeat and are as fine as or finer than the MD threads, the MD threads and the CD threads as well as the MDF threads being made of polymeric material.

It should be noted that the fabric according to the invention has reinforcing threads in the machine direction MD only. There are no reinforcing threads in the bottom transversely of the machine direction. It should also be noted that the flotations on the bottom surface, which are provided by the MDF threads, are between themselves equally long since the MDF threads bind with the CD threads only once per repeat.

The MD threads, CD threads and MDF threads included in the fabric can individually be chosen with a circular or non-circular cross-section. The above expression "as fine as or finer" concerns the relationship between the cross-sectional areas of the threads. For threads having a circular cross-section, the MDF threads are, according to the invention, not allowed to have a larger diameter than the MD threads. As an example, it is possible to choose thread diameters in the order of 0.15 mm in the bottom for the MDF threads and 0.17 mm for the MD and CD threads of the single-layered structure.

According to the invention, the reinforcing threads (MDF threads) are oriented in the machine direction (MD) of the fabric. If the fabric is manufactured as flat-woven fabric, both the MD threads of the single-layered structure and the MDF threads are warp threads, and the fabric is warp-reinforced. If, instead, one chooses to manufacture the fabric as round-woven fabric, which may be advantageous since no seam is required, the reinforcement will be made by shute wires, and the fabric will be shute-reinforced. Independently of the weaving technique, the fabric has, however, a defined machine direction and the reinforcing threads are oriented in this machine direction.

According to the invention, the reinforcing threads (MDF threads) bind with the CD threads in n-shed, where $n \geqq 5$. If n is chosen to be less than 5, shorter flotations and more binder points in the top will be obtained, which gives less material to wear in the bottom and more disturbances in the top surface.

In a preferred embodiment, the MD threads and CD threads of the single-layered structure include threads made of polyester (PET) and/or polyethylene naphthalate (PEN).

In a preferred embodiment, the reinforcing threads (MDF threads) include threads that are made of polyamide (PA).

In addition to the embodiments that are specifically stated in the preceding two paragraphs, materials for the various threads can be chosen specifically according to that stated in the dependent claims.

The number of MD threads in relation to the number of MDF threads is preferably 1:1, but the ratio 2:1 is also possible. A lower count on the MDF threads is not preferred since the desired purposes of the reinforcement are then not achieved.

DESCRIPTION OF AN EMBODIMENT

As mentioned above, the following is applicable to all embodiments of the invention:

1. The weave pattern is 2-shed for the single-layered structure, which is made up of MD threads and CD threads, i.e., the MD threads bind with the CD threads in 2-shed.
2. The weave pattern is $n \geqq 5$ for the MDF threads (i.e., the MD reinforcing threads in the bottom), which each binds with the CD threads in the surface once per repeat for the MDF threads. This binding can be a pattern in an even or an odd number of shafts, for example, 5-, 7-, 8- or 10-shed.

The complete weave repeat must be distributed on an even number of shafts such that the surface pattern is repeated evenly over the bottom pattern. Thus, a 5- and 7-shed pattern must be distributed over at least 10- and 14-harnesses, respectively.

Four examples of possible weave patterns for the single-layered structure (always in 2-shed, harness No. 1–10) and the reinforcing threads in the MD (harness No. 11–20), respectively, will be found. The "X" in the Tables means that an MD thread or, alternatively, an MDF thread binds over a CD thread. In all examples, the MDF weave repeat (harness No. 11–20) does not show closed diagonals.

EXAMPLE 1: 2/10-shed MD reinforced

| | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| 1 | X | | X | | X | | X | | X | | X | | | | | | | | | |
| 2 | | X | | X | | X | | X | | X | | | | | | | | X | | |
| 3 | X | | X | | X | | X | | X | | | | | | X | | | | | |
| 4 | | X | | X | | X | | X | | X | | X | | | | | | | | |
| 5 | X | | X | | X | | X | | X | | | | | | | | | | X | |
| 6 | | X | | X | | X | | X | | X | | | | | | X | | | | |
| 7 | X | | X | | X | | X | | X | | | | X | | | | | | | |
| 8 | | X | | X | | X | | X | | X | | | | | | | | | | X |
| 9 | X | | X | | X | | X | | X | | | | | | | | X | | | |
| 10 | | X | | X | | X | | X | | X | | | | X | | | | | | |

Figure 1A:
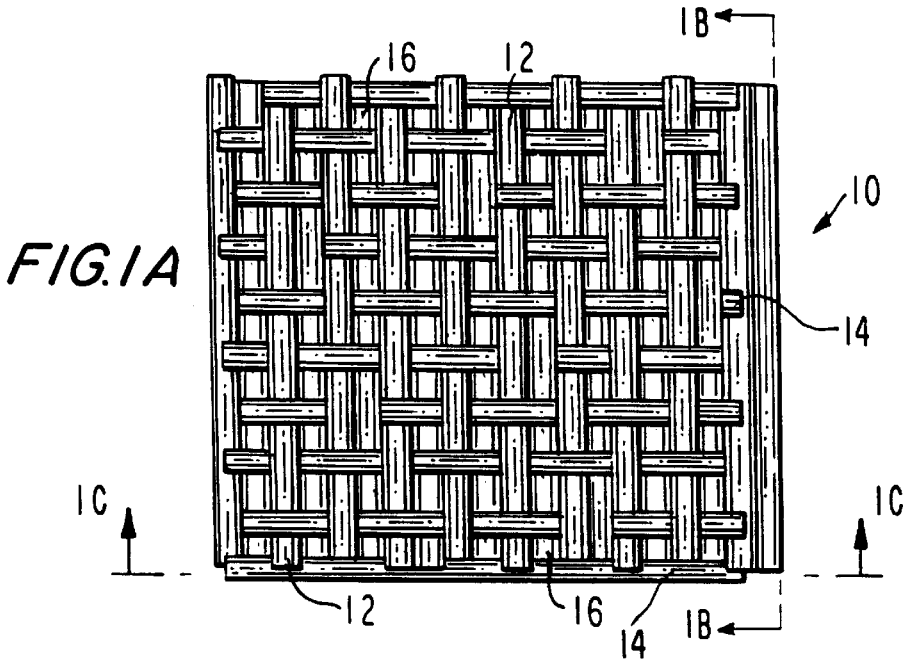
FIG. 1A is a top view of the embodiment identified below as Example 1.

FIG. 1A is a top view of the fabric 10 of Example 1. MD threads 12 bind with CD threads 14 in a 2-shed pattern. MDF threads 16 bind with the CD threads 14 in the surface once per repeat in a 10-shed weave.

Figure 1B:
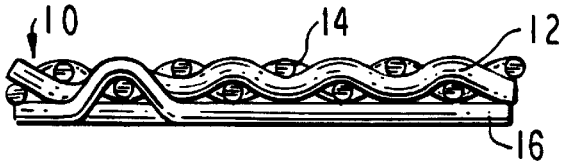
FIG. 1B is a cross-sectional view taken in the machine direction (MD) as indicated in FIG. 1A.
Figure 1C:
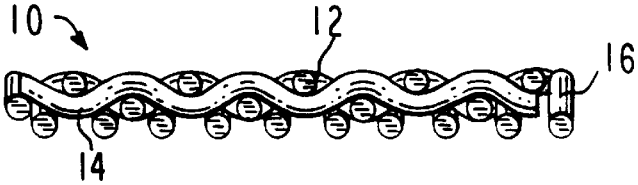
FIG. 1C is a cross-sectional view taken in the cross-machine direction (CD) as indicated in FIG. 1A.

FIG. 1B is a cross-sectional view taken in the machine-direction (MD) as indicated in FIG. 1A, and FIG. C is a cross-sectional view taken in the cross-machine direction (CD) as indicated in FIG. 1A.

Figure 1D:
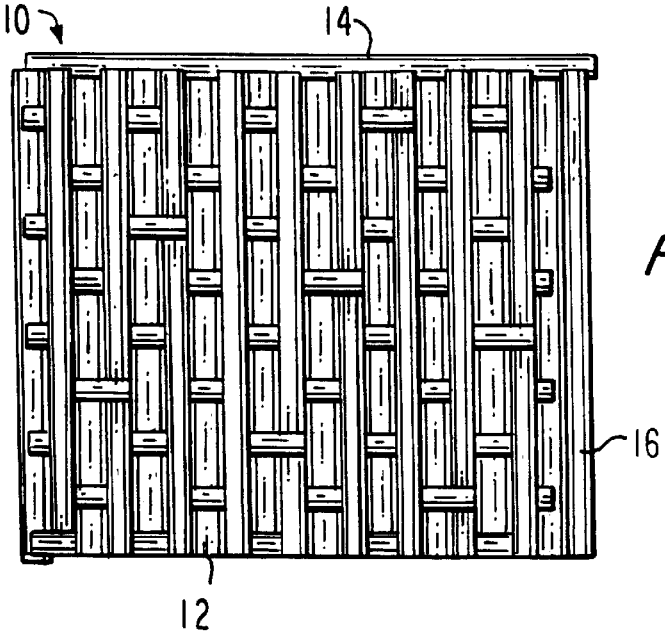
FIG. 1D is a bottom view of the embodiment of Example 1.

FIG. 1D is a bottom view of fabric 10, and shows MDF threads 16 binding with only one CD thread 14 per repeat.

EXAMPLE 2: 2/10-shed MD reinforced with broken diagonal

| | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| 1 | X | | X | | X | | X | | X | | | | | | | | X | | | |
| 2 | | X | | X | | X | | X | | X | | | | X | | | | | | |
| 3 | X | | X | | X | | X | | X | | X | | | | | | | | | |
| 4 | | X | | X | | X | | X | | X | | | | | | | | X | | |
| 5 | X | | X | | X | | X | | X | | | | | | X | | | | | |
| 6 | | X | | X | | X | | X | | X | | | | | | | | | | X |
| 7 | X | | X | | X | | X | | X | | | | X | | | | | | | |
| 8 | | X | | X | | X | | X | | X | | | | | | X | | | | |
| 9 | X | | X | | X | | X | | X | | | | | | | | | | X | |
| 10 | | X | | X | | X | | X | | X | | X | | | | | | | | |

Figure 2:
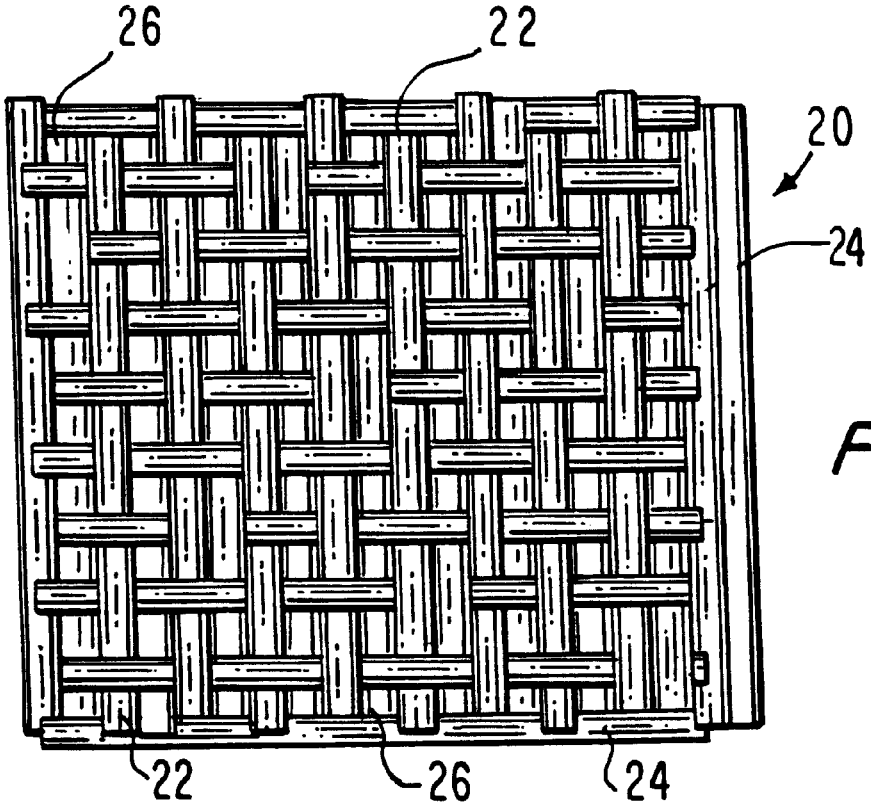
FIG. 2 is a top view of the embodiment identified below as Example 2.

FIG. 2 is a top view of the fabric 20 of Example 2. MD threads 22 bind with CD threads 24 in a 2-shed pattern. MDF threads 26 bind with the CD threads 24 in the surface once per repeat in a 10-shed weave.

EXAMPLE 3: 2/5-shed MD reinforced

| | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| 1 | X | | X | | X | | X | | X | | X | | | | | X | | | | |
| 2 | | X | | X | | X | | X | | X | | | | X | | | | | X | |
| 3 | X | | X | | X | | X | | X | | | X | | | | | X | | | |
| 4 | | X | | X | | X | | X | | X | | | | | X | | | | | X |
| 5 | X | | X | | X | | X | | X | | | | X | | | | | X | | |
| 6 | | X | | X | | X | | X | | X | X | | | | | X | | | | |
| 7 | X | | X | | X | | X | | X | | | | | X | | | | | X | |
| 8 | | X | | X | | X | | X | | X | | X | | | | | X | | | |
| 9 | X | | X | | X | | X | | X | | | | | | X | | | | | X |
| 10 | | X | | X | | X | | X | | X | | | X | | | | | X | | |

Figure 3:
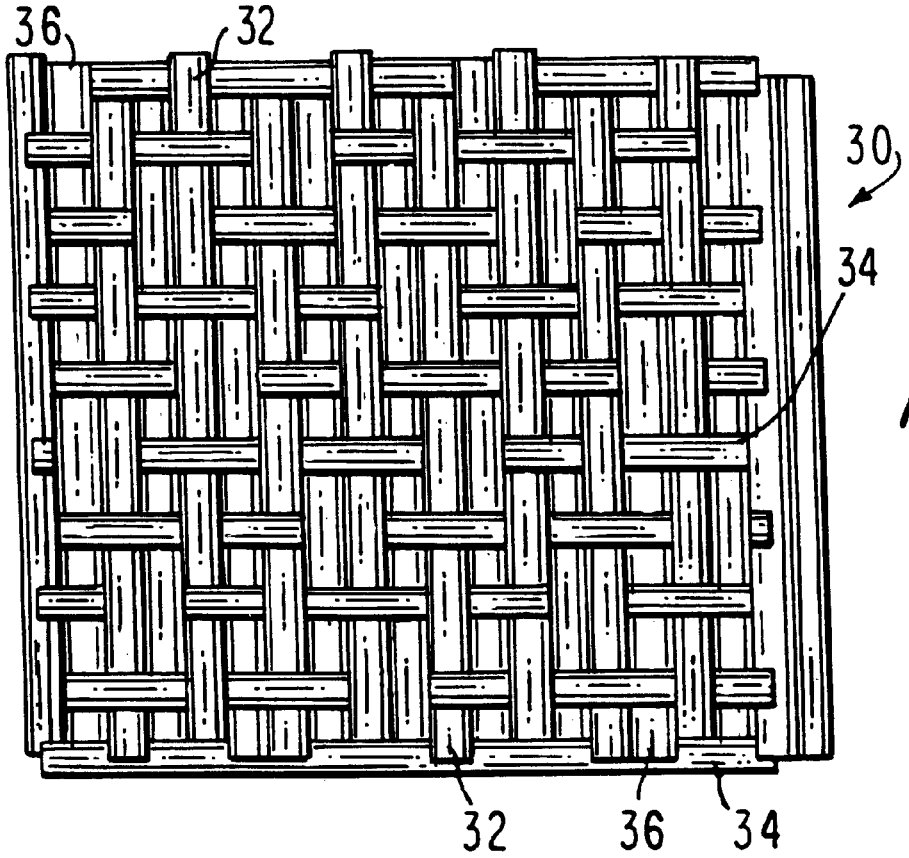
FIG. 3 is a top view of the embodiment identified below as Example 3.

FIG. 3 is a top view of the fabric 30 of Example 3. MD threads 32 bind with CD threads 34 in a 2-shed pattern. MDF threads 36 bind with the CD threads 34 in the surface once per repeat in a 5-shed weave.

EXAMPLE 4: 2/5-shed MD reinforced with broken 5-shed distributed in 10 harnesses

| | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| 1 | X | | X | | X | | X | | X | | X | | | | | X | | | | |
| 2 | | X | | X | | X | | X | | X | | | | X | | | | X | | |
| 3 | X | | X | | X | | X | | X | | | X | | | | | | | | X |
| 4 | | X | | X | | X | | X | | X | | | | | X | | X | | | |
| 5 | X | | X | | X | | X | | X | | | | X | | | | | | X | |
| 6 | | X | | X | | X | | X | | X | X | | | | | X | | | | |
| 7 | X | | X | | X | | X | | X | | | | | X | | | | X | | |
| 8 | | X | | X | | X | | X | | X | | X | | | | | | | | X |
| 9 | X | | X | | X | | X | | X | | | | | | X | | X | | | |
| 10 | | X | | X | | X | | X | | X | | | X | | | | | | X | |

Figure 4:
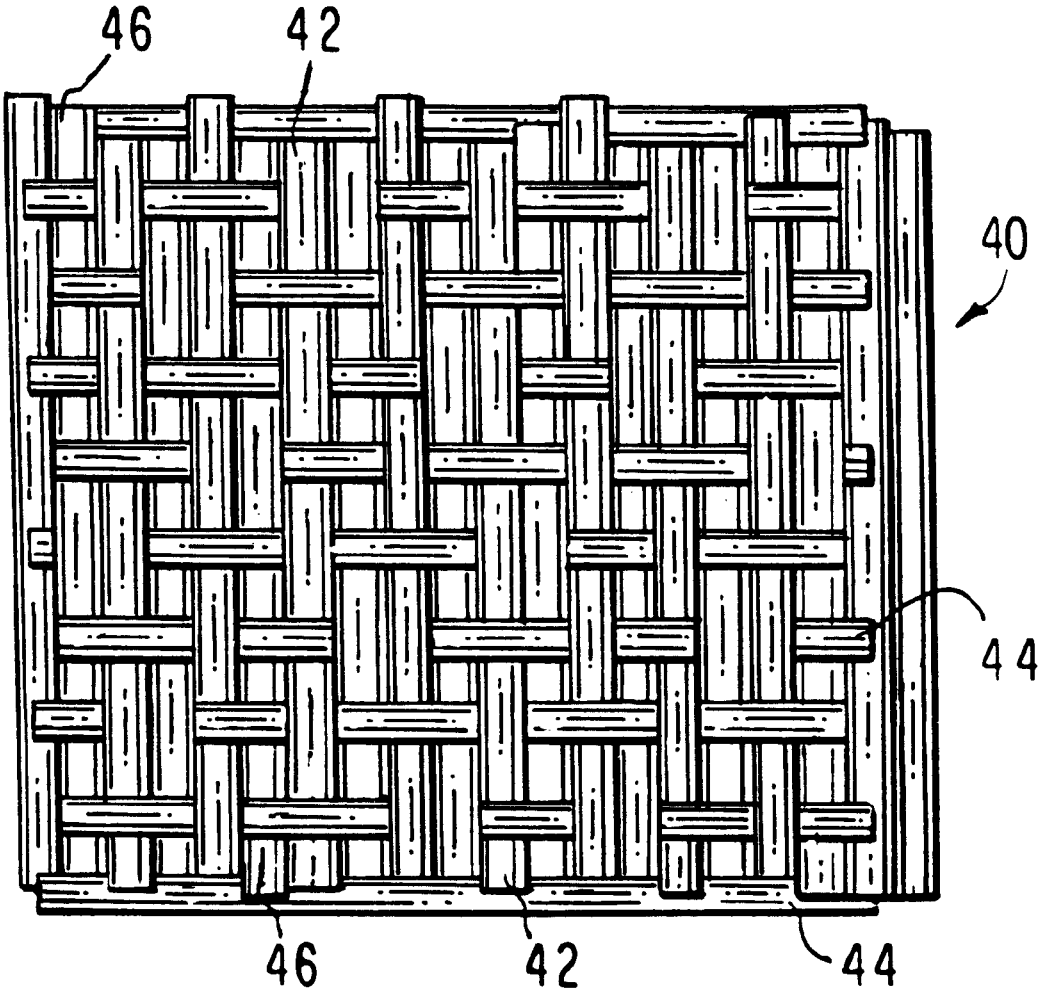
FIG. 4 is a top view of the embodiment identified below as Example 4.

FIG. 4 is a top view of the fabric 40 of Example 4. MD threads 42 bind with CD threads 44 in a 2-shed pattern. MDF threads 46 bind with the CD threads 44 in the surface once per repeat in a 5-shed weave.

This pattern can also be made analog in broken distribution on 7/14 and 8/16-shed, respectively.

It is possible to dress the loom with repeated change of diagonals in a weave pattern like in this broken 5-shed, which facilities the guiding of the fabric and reduces the risk of a diagonal pattern arising in the paper web during the forming process in the wire section.

The woven fabric according to the invention having the features stated above confers a number of advantages compared with the fabrics used today:

1. Reduced Marking

The fabric top surface carrying the web of material has a 2-shed binder pattern, which from the viewpoint of marking gives an optimum top surface with a minimum of marking. A 2-shed surface has a great number of support points and drainage holes, which besides are evenly distributed over the entire surface. Consequently the marking will be small, since, among other things, the eye does not perceive the pattern as particularly disturbing, compared with diagonal patterns. It should be especially noted that the MD reinforcement, i.e., the MDF threads, binds only over one CD thread per repeat of the MDF threads, and therefore the MDF threads do not create any marking flotations on the top surface, which thus maintains its 2-shed surface. In addition, according to the invention, the MDF threads are not allowed to be coarser than the MD threads, which is also a reason why the desired 2-shed surface is not affected by the MDF threads.

2. Higher Machine Speed

The machine speed can be increased compared with cases where single-layered fabrics are run today.

3. Clean Fabric

The fabric according to the invention keeps clean more easily compared with known fabrics, which makes it possible to prolong the intervals between breaks for cleaning. The reason why the fabric keeps clean more easily is that dirt/fibers are more easily washed away by the showering (effected continuously or discontinuously during production) since the drainage channels are short and there is not much material in the fabric that can prevent such washing away.

4. Rapid Dewatering and Small Amount of Dragged Water

The low fabric caliper and the fact that the fabric has many drainage holes evenly spread over the surface lead to improved dewatering of the web of material. As a consequence, the amount of dragged water is reduced such that disturbances and water spouting are reduced. If the fabric is especially used as base fabric in a press felt, the increased dewatering will reduce the rewetting at the output side of the press nip. The fact that the reinforcing threads (MDF threads) are oriented in the machine direction and not in the cross direction also positively contributes to their not dragging water in the bottom of the fabric.

5. Life

The MDF thread flotations on the bottom surface of the single-layered structure increase the wear resistance of the fabric, and there is an acceptable amount of material (i.e., the MDF threads) to wear at a normal life cycle of the fabric.

6. Installation

The installation of a fabric according to the invention is simplified owing to the fact that the fabric has a smaller weight and is less stiff and rigid compared with today's thicker two- or three-layered fabrics.

7. Economy

The flotations made by the MDF threads on the bottom surface in the machine direction result in low friction against the supporting machine parts and therefore contribute to a decrease of the power consumption. Since the fabric keeps clean more easily and, if contaminated, is easier to clean, less energy is required to remove dirt/fibers, if any.

Regarding the MDF threads, the following main purposes can be summed up:

Smaller risk of tensioning

Wear resistance in the fabric

Water-guiding (channeling) in the machine direction

Reduction of friction against supporting machine elements.

The fabric according to the invention has been especially developed for use as a forming fabric. The concept involving an MD reinforced pattern with a 2-shed surface on top (which results in low marking and many contact points) can, however, also be used for a base fabric in a press felt, as a dryer fabric or as a part of a process belt. The demands placed on the material must then be adapted to the respective environments regarding load, temperature, function and dewatering requirements. For instance, when applying the fabric as a dryer fabric, it must be resistant to hydrolysis, resistant to wear in wet and dry heat and dimensionally stable. When applying the fabric as a process belt, the open structure of the fabric may contribute to a coating of polymeric material penetrating to a desired level or completely "bleeding through" the fabric.

Independently of the chosen cross-section of the threads included in the fabric, the MDF threads are, in a preferred embodiment, finer than the MD threads. The advantage of having finer MD threads is to prevent the MDF threads from disturbing the 2-shed surface. A further advantage is, as will appear from the next paragraph, that finer MDF threads may cause an advantageous difference in modulus/tension between, on the one hand, the single-layered structure and, on the other hand, the reinforcement.

Regarding the MD threads and the CD threads in the single-layered structure, these should not differ too much from each other in respect of dimension since this may lead to instability. Normally they have the same dimension, but if different materials are chosen for the MD threads and the CD threads, a certain compensation can be made by choosing different dimensions.

According to a preferred embodiment, the modulus of the MDF threads in unwoven condition is lower than the modulus of the MD threads in unwoven condition. This embodiment is advantageous by the 2-shed top surface then not being disturbed by the MDF threads in case of an elongation in the MD. By limiting the modulus of the MDF threads, one prevents these from undesirably dragging down the CD threads and thereby creating marking holes/craters in the top surface when the fabric, while being manufactured, is tensioned in the heat-setting process. However, it is preferable that the material in the MDF threads have a certain shrinkage during the cooling phase after the heat-setting process, such that the MDF flotations on the bottom surface do not create arcs during the relaxation of the fabric after the heat-setting process. This difference in modulus between the MDF threads and the MD threads can be obtained by choosing a finer thread dimension for the MDF threads than for the MD threads or by the choice of material.

What is claimed is:

1. A woven fabric for a paper machine, board machine or the like, said fabric having, in operation, a defined machine direction (MD) and a defined cross direction (CD) and comprising:

a single-layered structure formed of threads in the machine direction (MD threads) that bind with threads in the cross direction (CD threads) in a 2-shed repeated pattern for the creation of a 2-shed top surface carrying a web of material, and a reinforcement arranged on the bottom surface of the single-layered structure and being in the form of reinforcing threads in the machine direction (MDF threads), which bind only with the CD threads in a n-shed repeated pattern, where $n \geqq 5$, and thereby create reinforcing flotations in the machine direction on the bottom surface of the single-layered structure, said MDF threads binding only with one CD thread per repeat and being as fine as or finer than the MD threads, the MD threads and the CD threads as well as the MDF threads being made of polymeric material.

2. A fabric according to claim 1, wherein the MDF threads are finer than the MD threads.

3. A fabric according to claim 1, wherein the MDF thread modulus in unwoven condition is lower than the MD thread modulus in unwoven condition.

4. A fabric according to claim 1, wherein the MDF threads are made of a material other than that/those used for the MD threads and CD threads of the single-layered structure.

5. A fabric according to claim 4, wherein the MD threads and CD threads of the single-layered structure are made of the same material.

6. A fabric according to claim 4, wherein the MD threads and CD threads of the single-layered structure are made of different materials.

7. A fabric according to claim 4, wherein the MD threads and/or CD threads of the single-layered structure comprise threads made of polyester (PET).

8. A fabric according to claim 4, wherein the MD threads and/or CD threads of the single-layered structure comprise threads made of polyethylene naphthalate (PEN).

9. A fabric according to claim 1, wherein the MD threads comprise threads made of a wear-resistant material, such as polyamide (PA).

10. A fabric according to claim 1, wherein the MD threads of the single-layered structure, the CD threads of the single-layered structure, and the MDF threads comprise threads made of the same material.

11. A fabric according to claim 10, wherein said same material is polyester (PET).

12. A fabric according to claim 1, claims, wherein the MD threads are warp threads and the CD threads are shute threads.

13. A fabric according to claim 1, wherein the CD threads are warp threads and the MD threads are shute threads.

14. A fabric according to claim 1, wherein the CD threads and MD threads of the single-layered structure are equally fine.

15. A fabric according to claim 1, wherein the number of MD threads in relation to the number of MDF threads is 1:1.

16. A fabric according to claim 1, wherein the number of MD threads in relation to the number of MDF threads is 2:1.

* * * * *